US006204227B1

(12) United States Patent
Rao et al.

(10) Patent No.: US 6,204,227 B1
(45) **Date of Patent: *Mar. 20, 2001**

(54) METAL WORKING LUBRICANT COMPOSITION

(75) Inventors: Arvind M. N. Rao, Monmouth Junction, NJ (US); Douglas G. Placek, Yardley, PA (US)

(73) Assignee: PABU Services, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/256,063

(22) Filed: Feb. 24, 1999

Related U.S. Application Data

(60) Provisional application No. 60/076,394, filed on Feb. 28, 1998, now abandoned.

(51) Int. Cl.[7] ..... C10M 137/04
(52) U.S. Cl. ..... 508/433; 508/577; 72/42
(58) Field of Search ..... 508/433, 436, 508/577; 72/42

(56) References Cited

U.S. PATENT DOCUMENTS

| | | | | |
|---|---|---|---|---|
| 3,483,122 | * | 12/1969 | MacPhail | 508/433 |
| 3,978,908 | | 9/1976 | Klaus et al. | 164/72 |
| 4,362,634 | | 12/1982 | Berens et al. | 252/49.5 |
| 4,654,155 | | 3/1987 | Kipp et al. | 252/32.5 |
| 4,765,917 | | 8/1988 | Otaki et al. | 252/40.7 |
| 4,822,507 | * | 4/1989 | Kanamori | 508/438 |
| 5,206,404 | | 4/1993 | Gunkel et al. | 558/146 |
| 5,495,737 | | 3/1996 | Graham | 72/42 |
| 5,584,201 | * | 12/1996 | Graham et al. | 72/42 |

FOREIGN PATENT DOCUMENTS

WO 9302164 2/1993 (WO) .

* cited by examiner

*Primary Examiner*—Margaret Medley
*Assistant Examiner*—Cephia D. Toomer
(74) *Attorney, Agent, or Firm*—Woodard, Emhardt, Naughton, Moriarty & McNett

(57) ABSTRACT

Concentrated lubricant compositions that, upon dilution, produce emulsions that are useful as lubricants in metal working processes are described. The compositions comprise a substantially neutral phosphate ester and one or more non-ionic surfactants. By appropriate choice of surfactants both microemulsions and macroemulsions can be produced. The emulsions are stable for at least one month at room temperature and offer improved lubricity when used in metal working operations.

33 Claims, 1 Drawing Sheet

METAL WORKING LUBRICANT COMPOSITION

CROSS-REFERENCE TO RELATED APPLICATIONS

This application claims priority from U.S. Provisional Application 60/076,394, filed Feb. 28, 1998, incorporated herein by reference, now abandoned.

TECHNICAL FIELD

This invention relates to concentrated lubricant compositions that, upon dilution with water, produce emulsions that are useful as lubricants in metal working processes.

BACKGROUND

Metal working processes of many kinds are used in the fabrication of metal goods. Typically metal is removed from the workpiece during metal working. Examples of metal working processes include machining, cutting, drilling, grinding, turning, milling, tapping and broaching. Metal working differs from metal forming. In metal forming typically no metal is removed. Examples of metal forming processes include rolling, forging, molding, stamping, casting, ironing, drawing, and extruding. In metal forming operations, the metal is typically preheated to at least about 800° C. so that the metal can be more easily formed into the desired shape. In metal working operations, the metal is typically not preheated; the only heat incident to the operation is that caused by the metal working operation itself.

In all metal working operations it is necessary to lubricate the interface between the workpiece and the tool to decrease the force required to work the metal; to cool the workpiece; to remove chips from the cutting zone; to impart a good surface finish; and to extend the life of the tool. The formulation of lubricant compositions is complex, because a wide variety of compounds may be used, as, for example, antifriction agents, anticorrosion agents, surfactants, and biocides.

Triaryl phosphate esters have been proposed for use in metal working lubricant compositions. Berens, U.S. Pat. No. 4,362,634, discloses metal working lubricant compositions that comprise a polyol ester, such as a pentaerythritol/fatty ester, as the major ingredient together with a triaryl phosphate ester and a carboxylic ester non-ionic surfactant of the anhydrosorbitol or glycerol ester type, such as sorbitan monotallate. The phosphate ester comprises 1 to 10 weight % of the concentrated lubricant composition. About 2 to 30 weight % of concentrated composition can be dispersed with water to form a diluted lubricant composition as an emulsion that was reported to be phase stable for at least one hour under quiescent conditions.

Metal working lubricant compositions are preferably produced as concentrates, which are diluted prior to use. Concentrated lubricant compositions are prepared by the manufacturer and shipped in drums to the user, who may store the drums of concentrated lubricant composition for several weeks to months prior to use. Because the lubricant properties of the metal working lubricant composition are typically lost if the lubricant composition deemulisifies, the concentrated lubricant composition should have a shelf life (stability, i.e., time before deemulsification occurs) at room temperature (about 25° C.) of at least one month, and preferably at least six months. The high temperature (about 75° C.) stability and the low temperature stability (about −15° C.) should each be at least 5 days. Following dilution of the concentrated lubricant composition, the resulting diluted lubricant composition should have a shelf life at room temperature of at least one month, preferably at least six months, a high temperature stability of at least one day and a low temperature stability of at least one day.

Thus, there is a need in the art for both concentrated and diluted metal working lubricant emulsions that are stable for longer periods so that they can be produced and stored for longer periods of time prior use.

SUMMARY OF THE INVENTION

In one aspect the invention is a concentrated lubricant composition useful upon dilution with water as a lubricant in metal working operations. The concentrated lubricant composition comprises:

- a substantially neutral phosphate ester; optionally, an extreme pressure additive;
- a surfactant;
- a non-ionic alcohol; and
- water;

in which:

- the phosphate ester and the extreme pressure additive together comprise 5 to 30% by weight of the composition;
- the surfactant and the non-ionic alcohol together comprise 10 to 60% by weight of the composition;
- the ratio of the total weight of the surfactant and the non-ionic alcohol to the total weight of the phosphate ester and the extreme pressure additive is 2:1 to 12:1; and
- the composition is an emulsion.

In another aspect, the invention is concentrated lubricant composition for use in metal working operations.

The composition comprises:

- a substantially neutral phosphate ester;
- optionally, an extreme pressure additive;
- a high HLB surfactant; and
- water;

in which:

- the phosphate ester and the extreme pressure additive together comprise 5% to 20% by weight of the composition;
- the surfactant comprises 2.5% to 20% by weight of the composition;
- the ratio of the weight of the surfactant to the total weight of the phosphate ester and the extreme pressure additive is 0.5:1 to 2:1, and
- the composition is a macroemulsion.

In yet another aspect, the invention is a process for using these compositions in metal working operations.

The concentrated lubricant composition emulsions typically are stable on storage at room temperature for up to about six months. When diluted, the diluted lubricant composition emulsions are stable on storage at room temperature for at least ten days, typically at least one month, and offer improved lubricity when used in metal working operations.

DETAILED DESCRIPTION OF THE INVENTION

Figure 1:
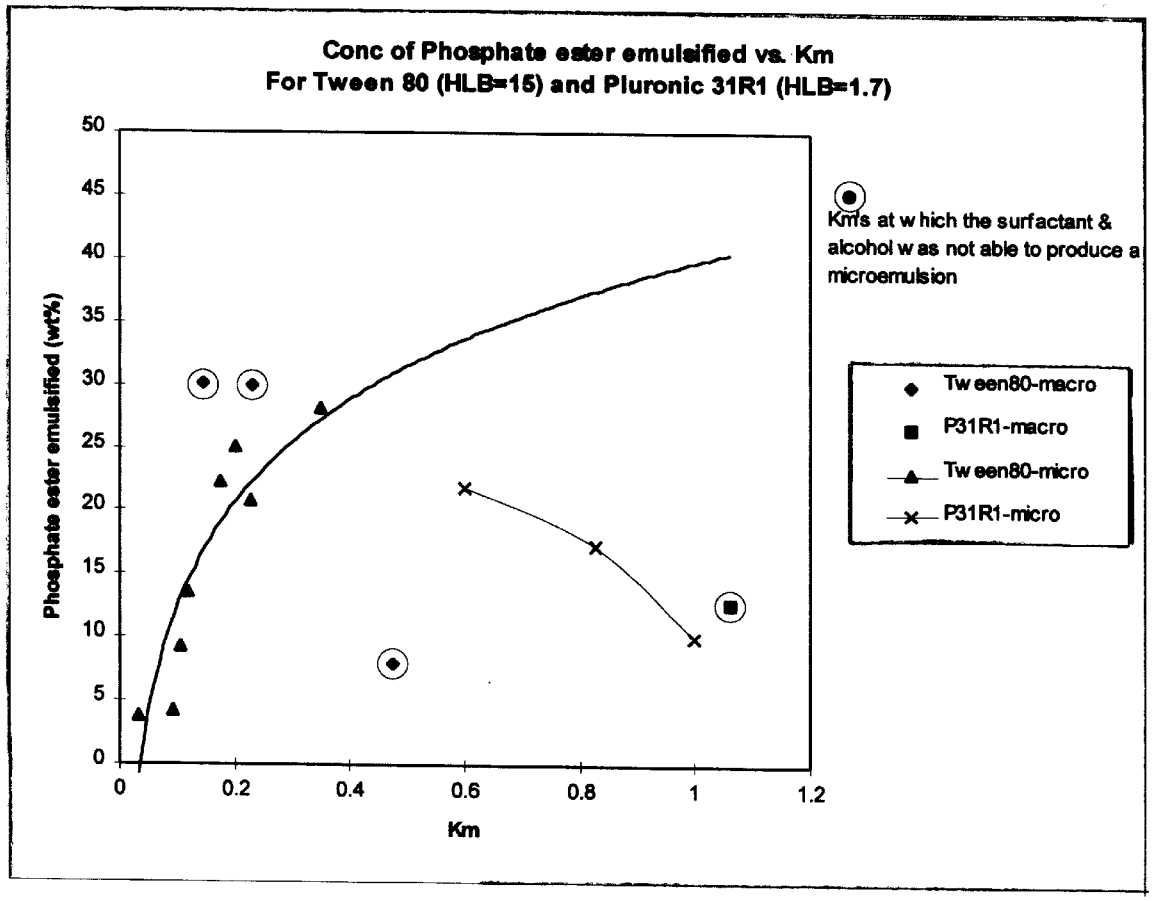
FIG. 1 is a plot of the amount of phosphate ester incorporated into a concentrated lubricant composition against the ratio of the amount of non-ionic surfactant in the composition (in wt %) to the amount of non-ionic alcohol in the composition (in wt %).

Metal working lubricant compositions can be produced as emulsions having improved stability using neutral or substantially neutral phosphate esters in combination with non-ionic surfactants and other optional organic components. These compositions are free from organic solvents, such as mineral oils, chlorinated paraffins, or other hydrocarbons. These materials, which are used in many commercial metal working lubricant compositions, may adversely affect the stability of the emulsion.

The substantially neutral phosphate ester provides extreme pressure lubricity. It also serves as a carrier for the other components of the composition and thereby obviates the need to introduce additional solvents, such as those mentioned above.

Phosphate esters that may be useful include, for example, triaryl phosphates derived from natural phenols such as tricresyl phosphate and trixylyl phosphate; triaryl phosphates derived from synthetic alkylated phenols, such as tris(iso-propylphenyl)phosphate and tris(tert-butyl-phenyl) phosphate; alkyl/aryl phosphates obtained by the phosphorylation of a mixture of phenols and aliphatic alcohols such as 2-ethylhexyl diphenyl phosphate (Monsanto, Santicizer® 141), iso-decyl diphenyl phosphate (Santicizer® 148) and a C12 to C14 alkyl diphenyl phosphate (Santicizer® 2148); and the trialkyl phosphates such as tri(iso-butyl)phosphate, tri(2-ethylhexyl)phosphate and tributyl phosphate.

The phosphate esters should be relatively hydrolytically stable liquids that have a relatively low volatility. Useful phosphate esters include triaryl phosphate esters, especially the substantially neutral trisubstituted esters having the formula I:

$$PO(OR_1)(OR_2)(OR_3) \qquad \text{I}$$

in which $R_1$ $R_2$ and $R_3$, which may be the same or different, each represent (a) an aryl group, such as phenyl; (b) a substituted aryl group, such as phenyl, substituted with 1 to 3 alkyl groups in which each alkyl group independently contains 1 to 6 carbon atoms; or (c) an alkyl group comprising 3 to 18 carbon atoms.

These phosphate esters are generally obtained by the phosphorylation of alkyl phenols, which may be obtained from a natural or a synthetic source. Those obtained from a synthetic source are obtained by the reaction of phenol with an alkene, usually propylene or iso-butylene, to produce a mixture of phenol and alkyl substituted phenol, sometimes called a phenol alkylate, followed by phosphorylation of the phenol alkylate. Substantial neutrality is achieved by control of reaction conditions and/or by treatment of the product with alkali (such as NaOH) without hydrolyzing, to achieve a total acid number (TAN) of not over 0.25 mg KOH/g, as measured by ASTM D974, preferably less. The products are substantially hydrocarbon soluble and water insoluble. Purification of aryl phosphate esters is described in Gunkel, U.S. Pat. No. 5,206,404.

These mixed phosphate esters typical comprise triphenyl phosphate; diphenyl mono(alkylphenyl)phosphate; phenyl di(alkylphenyl)phosphate and tri(alkylphenyl)phosphate. Preparation of mixed synthetic triaryl phosphate esters is described in Randell, U.S. Pat. No. 4,093,680. The preferred phosphate esters are mixed alkylated triphenyl phosphates comprising about 1 to about 35% by weight, preferably about 15 to about 35% by weight, tri(alkylphenyl) phosphate; about 10 to about 55% by weight, preferably about 30 to 55% by weight, of di(alkylphenyl)monophenyl phosphate; from about 10 to about 60% by weight, preferably about 10 to 25% by weight, of mono(alkylphenyl) diphenyl phosphate and less than about 5% by weight, preferably less than about 2% by weight, of triphenyl phosphate. Preferably the alkyl substituent is iso-propyl (i.e., a phenol alkylate obtained from alkylation of phenol with propylene) or t-butyl (i.e., a phenol alkylate obtained from alkylation of phenol with iso-butylene). Most preferably the alkyl substituent is t-butyl. These phosphate esters are commercially available.

Part of the phosphate ester may be replaced by an extreme pressure additive. As used herein, the term "extreme pressure additive" does not include the phosphate ester. The extreme pressure additive may replace up to 33% by weight, typically about 10% by weight, of the phosphate ester. Extreme pressure additives reduce the force required for processing. This reduces wear and tear on the machine.

Useful organic-sulfur-containing extreme pressure additives include sulfur containing compounds known to be useful as extreme pressure additives in lubricant compositions. These additives are "organic" additives, i.e., compounds that do not dissociate in aqueous media to form ionic species to any significant degree. Examples of useful sulfur containing additives include sulfurized olefins; phosphinothio(thio)propanoic acid alkyl esters, such as those sold as Irgalube® 63 (Ciba); phosphorothionate esters, such as triphenyl phosphorothionate, sold as Irgalube® TPPT (Ciba); and other alkylated phenyl phosphorothionates, such as those sold as Irgalube® 211 (Ciba). If a phosphorothionate is used as the extreme pressure additive, care must be taken in the selection of the surfactant. The amount used should not be such to render the emulsion formed by diluting the concentrated lubricant composition unstable. If a particular emulsion has less than acceptable stability, it may be necessary to select another extreme pressure additive, to use a different amount of the additive, or to completely eliminate the extreme pressure additive from the composition.

The surfactant, or emulsifier, is a non-ionic surfactant or a mixture of non-ionic surfactants. It is preferably non-volatile, hydrolytically stable, and does not form a residue when degraded by contact with a metal surface. It should be capable of forming both a stable concentrated lubricant composition and a stable diluted lubricant composition.

Non-ionic surfactants include fatty alcohol ethoxylates, sorbitan ester ethoxylates, alkyl phenol ethoxylates, polyoxyethylene/polyoxypropylene block copolymers, and other compounds such as those disclosed in *Industrial*

*Applications of Surfactants,* D. R. Karsa, ed., The Royal Society of Chemistry, London, 1987, *Industrial Chemical Thesaurus,* 2nd Edition., Vol. 1, M. Ash and I. Ash, ed., VCH, New York, 1992, the chapter on "Surfactants" in the *Kirk-Othmer Encyclopedia of Chemical Technology,* Interscience, New York, and similar textbooks and publications.

The nature and stability of the emulsion is affected by the nature of the phosphate ester, the nature and quantity of the surfactant or surfactants, and the nature and quantity of the other ingredients incorporated into the composition. By careful choice of surfactant (or combination of surfactants) it is possible to prepare stable emulsions that are either macroemulsions or microemulsions. Typically macroemulsions are opaque in appearance and comprise dispersed droplets having a diameter of 1 to 10 micron. Microemulsions are transparent or semitransparent in appearance and comprise droplets having a diameter of less than 1.0 micron. Although both macroemulsions and microemulsions may be used as lubricant compositions in metal working operations, microemulsions are preferred Microemulsions are typically more stable than macroemulsions, are transparent so they do not obscure the operator's view of the metal working operation, and typically give superior overall performance.

To form a macroemulsion, a non-ionic surfactant having an HLB (hydrophilic/lipophilic balance) value greater than about 12 is used. The determination of HLB is well known to those skilled in the art. HLB values for many surfactants are available in the literature. Preferably the HLB is greater than about 15. Surfactants that are not non-ionic alcohols as herein defined and that have an HLB greater than 12 are referred to herein as "high HLB surfactants." Typically these compounds are ethoxylate esters of carboxylic acids (i.e., esters of carboxylic acids in which the alcohol is a polyethylene glycol, also known as polyoxyethylene glycol esters). Preferred high HLB surfactants are ethoxylate esters that comprise at least 4, preferably at least 6, and more preferably at least 10 moles of ethylene oxide. High HLB surfactants useful for forming macroemulsions include, for example:

- polyoxyalkylene glycol esters of long chain carboxylic (i.e., fatty) acids, such as PEG-6 laurate, PEG-8 oleate, PEG-6 stearate, PEG-10 stearate, PEG-12 stearate, PEG-8 myristate, etc., examples of which are Nopacol 4-L (Henkel) (PEG-8 laurate), Nopacol 6-L (Henkel) (PEG-12 laurate), Witconol 2711(PEG-8 stearate), Witconol 2713 (PEG-20 stearate) (Witco), etc.;
- castor oil ethoxylates and hydrogenated castor oil ethoxylates, especially those that comprise at least 36 moles of ethylene oxide, such as PEG-36 castor oil, PEG-40 castor oil, etc., examples of which are Witconol CO-360 (Witco) and DeSonic® 36C (DeSoto) (PEG-30 castor oil), and DeSonic® 40C (DeSoto) and Surfactol® 365 (ChasChem) (PEG-40 castor oil); and
- tall oil ethoxylates, such as PEG-8 tallate, PEG-20 tallate, etc., an example of which is Ethofat® 242/25 (PEG-15 tallate) (Akzo);
- ethoxylates of the fatty acids derived from coconut oil, such as PEG-14 cocoate, an example of which is Ethofat® C/25 (Akzo) (PEG-15 cocoate); as well as ethoxylates of fatty acids derived from other natural sources such as lanolin and soybean oil;
- ethoxylates of sorbitol esters of fatty acids, examples of which are Tween® 20 (PEG-20 sorbitan laurate), Tween® 40 (PEG-20 sorbitan monopalmitate), Tween® 60 (PEG-20 sorbitan stearate), Tween® 80 (PEG-20 sorbitan oleate), Tween® 85 (PEG-20 sorbitan trioleate) (ICI), and Witconol 6907 (PEG-20 sorbitan tristerate (Witco).

Amine-neutralized ionic surfactants can be used in conjunction with high HLB surfactants to form macroemulsions. Suitable acids are those known to be useful in the art of metal working lubrication, preferably those comprising 6 or more carbon atoms, such as, fatty mono-, di- and tricarboxylic acids, for example, stearic acid, oleic acid, adipic acid, subacic acid and isophthalic acid. Other suitable acids are high molecular weight polyacrylic acids crosslinked with polyalkenyl polyether, such as those sold by B.F. Goodrich Company as Carbopol and Pemulin. In use, the acid is neutralized with an amine, typically an alkanol amine, especially triethanolamine. Inorganic bases normally should not be used because inorganic cations tend to destabilize the emulsion.

Surfactants having an HLB value of less than 7.0 are referred to herein as "low HLB surfactants." Preferably the HLB is less than 2.0. Low HLB surfactants include:

- fatty acid ester of polyols, such as the laurates, oleates and stearates of alcohols such as glycerol, ethylene glycol, propylene glycol and anhydrosorbitol, which may be the mono-, di- or, where appropriate, tri-esters, derived from those alcohols;
- high molecular weight polyethylene glycols (i.e., molecular weight greater than 1,500, such as PEG-32 and PEG-55); and
- polyoxyethylene/polyoxypropylene block copolymers, such as meroxapol 254 and poloxamer 335, etc, examples of which are Pluronic® L101, Pluronic® 22R4, Pluronic® 31R1, Pluronic® 1-81 (BASF), Macol® 34, and Macol® 108 (PPG). "Non-ionic alcohols" are surfactants that are not esters, e.g., are not polyoxyethylene glycol esters; have one or more free hydroxyl groups; and are of relatively low molecular weight, typically less than about 1,000, preferably less than 900, so that the free hydroxyl group or groups have a significant effect on their surfactant properties. Non-ionic alcohols with a HLB greater than 10 can be used to form microemulsions. Examples of non-ionic alcohols include:
- low molecular weight polyethylene glycols (i.e., molecular weight about 200 to 1,000), such as PEG-4 (PEG 200), PEG-6 (PEG 300), PEG-12(PEG 600), etc., examples of which are Carbowax® PEG 400, Carbowax® PEG 600, and Carbowax® PEG 900 (Union Carbide), ICI PEG 200 (IC), Pluracol® E 300 (BASF);
- ethoxylates of natural and synthetic straight or branched chain alcohols, especially of alcohols comprising at least 8 carbon atoms, such as PEG-8 lauryl ether, PEG-10 lauryl ether, PEG-12 cetyl ether; PEG-10 oleyl ether, PEG-10 myristyl ether, PEG-10 coconut alcohol, etc., examples of which are Macol® LA-12, Macol® TD-12(PPG), Brij® 56, Brij® 58 (ICI), Surfonic® L24-9 (Texaco), Neodol® 25-9, Neodol® 25-12, Neodol® 45-13 (Shell), and Genapol® C-200 (Hoechst Celanese); and
- ethoxylates of alkyl phenols, especially those containing at least seven moles of ethylene oxide, such as PEG-7 nonyl phenyl ether, PEG-10 nonyl phenyl ether, PEG-9 octyl phenyl ether, PEG-16 octyl phenyl ether, PEG-9 dodecyl phenyl ether, etc., examples of which are Witconol NP-90, Witconol OP-90, Witconol NP-110, Igepal® CA-630, Igepal® CA-720, DeSonic® D9, Tergitol® NP-7, Renex® 688, Sellig 08-100, Sellig 09-100, Sellig 011-100, Sellig 012-100, Triton® X-100, Triton® X-114, Triton® X-120 and Triton® X-305.

The lubricant compositions may comprise one or more additional components conventional in the art, such as antifungal agents, antibacterial agents, dyes, corrosion inhibitors, etc. The nature of these components and the amounts in which they are present is governed by the intended use of the composition. These additional components can be introduced into the concentrated lubricant composition at any convenient time. Alternatively, they may be mixed into the diluted lubricant composition after the concentrated lubricant composition is diluted, but before the diluted lubricant composition is used.

The pH of the concentrated lubricant composition is preferably alkaline, more preferably between 7.5 to 9.5. Where necessary, the emulsion may contain a base, preferably an organic base, in an amount effective to bring the pH within the preferred range. Preferred bases are amines, such as alkanolamines, especially triethanolamine. Inorganic bases normally should not be used to raise the pH of the composition because inorganic cations tend to destabilize the emulsion.

Concentrated lubricant compositions can be prepared as macroemulsions containing up to about 20% by weight, preferably about 5 to 15% by weight, of phosphate ester using high HLB surfactants. The composition should contain about 0.1 to about 20% by weight, typically 2.5% by weight to 20% by weight, of the high HLB surfactant. The ratio (by weight) of the high HLB surfactant to the phosphate ester and, if present, the extreme pressure additive, is typically about 0.5:1 to 2:1, more typically about 0.8:1 to 1.25:1, even more typically about 1:1. When the ratio is 1:1, the concentrated lubricant composition comprises about 0.1 to about 20% weight percent phosphate ester and, if present, extreme pressure additive, about 0.1 to about 20% weight percent high HLB surfactant. The balance is other ingredients and water. When an amine-neutralized ionic surfactant is used in conjunction with a high HLB surfactant to obtain a macroemulsion, between about 0.05 and about 15% by weight of the acid is used in the concentrated lubricant composition. Sufficient amine is used to adjust the pH to between 7.5 and 9.5.

High HLB and low HLB surfactants can each be used in conjunction with non-ionic alcohols to form concentrated lubricant compositions as microemulsions. When a microemulsion is formed, the phosphate ester and, if present, the extreme pressure additive, comprise up to about 30% by weight, typically about 5 to 30% by weight, preferably about 15 to 30% by weight, of the concentrated lubricant composition; the surfactant and non-ionic alcohol together comprise about 10 to 60% by weight, typically 20 to 60% by weight of the composition; and the ratio (by weight) of the total of the surfactant and the non-ionic alcohol to the total of phosphate ester and, if present, the extreme pressure additive, is about 2:1 to 12:1, preferably 3:1 to 10:1, more preferably 4:1 to 8:1. When present, the extreme pressure additive is preferably up to about 10% by weight of the concentrated lubricant composition The balance is other ingredients and water.

The appropriate combination of phosphate ester, high or low HLB surfactant or combination of surfactants, and non-ionic alcohol or combination of non-ionic alcohols, to produce the desired lubricant composition can be determined by routine experimentation. In general, the amount of phosphate ester that can be used in a microemulsion concentrated lubricant composition depends on both the type of surfactant and the ratio of the amount of non-ionic surfactant in the composition (in wt %) to the amount of non-ionic alcohol in the composition (in wt %). This ratio is designated $K_m$. FIG. 1 shows a plot of the amount of phosphate ester incorporated into a concentrated lubricant composition against $K_m$. Typically, this plot is more dependent on the nature of the non-ionic surfactant than on the nature of the non-ionic alcohol.

When a high HLB surfactant is used, the amount of phosphate ester that can be used in the emulsion increases with increasing $K_m$. The concentrated lubricant composition is obtained as clear, transparent, low viscosity microemulsion, which can be diluted as need for the metal working operation. When a low HLB surfactant is used, the amount of phosphate ester that can be used in the emulsion decreases with increasing $K_m$. The concentrated lubricant composition is obtained as clear, transparent, high viscosity microemulsion, which can be diluted as need for the metal working operation.

As will be apparent to those skilled in the art, different lubricant compositions, comprising different combinations and proportions of ingredients, may be particularly suited for different metal working operations.

Generally, the additional components, i.e., antifungal agents, antibacterial agents, dyes, corrosion inhibitors, etc., together typically comprise less than 5% by weight of the concentrated lubricant composition.

To prepare the concentrated lubricant composition as a microemulsion, the surfactant and the phosphate ester are mixed together and water added. If a high viscosity lubricant composition is desired, a low HLB surfactant should be used. If a low viscosity lubricant composition is desired, a high HLB surfactant should be used. The non-ionic alcohol is added, typically with gentle heating (30–50° C.) and moderate agitation until a clear microemulsion forms. The concentrated lubricant composition may be stored and diluted as needed for metal working applications.

In use, the concentrated lubricant composition is diluted to form a diluted lubricant composition. The degree of dilution will vary with the composition of the concentrated lubricant composition (i.e., the amount of triaryl phosphate ester in the concentrated lubricant composition, etc.), nature and severity of the metal working operation, and the manner in which the lubricant emulsion is to be applied. Dilution is typically about 1 part of concentrated lubricant composition to about 100 parts diluted composition (i.e., about 1% concentrated lubricant composition in the diluted composition) to about 50 part of concentrated lubricant composition to about 100 parts diluted composition (i.e., about 50% concentrated lubricant composition in the diluted composition), more typically about 5 to 25 parts of concentrated lubricant composition to about 100 parts of diluted lubricant composition, even more typically about 10 to 15 parts of concentrated lubricant composition to about 100 parts diluted composition.

The diluted lubricant composition is prepared by dispersing the concentrated lubricant composition in water with the aid of strong agitation provided by conventional impellers or ultrasonic devices. Although this composition is described as a "diluted lubricant composition," it can be prepared by other methods, such as by mixing the components in the required amounts, instead of diluting a pre-prepared concentrated lubricant composition. Because the diluted lubricant composition is typically used relatively soon after it is prepared, it does not have to have a long shelf life. A room temperature emulsion stability (shelf life) of at least one month, a high temperature stability of at least one day, and a low temperature stability of at least one day are generally adequate.

Together the triaryl phosphate ester and, if present, the extreme pressure additive typically comprise from 0.01% to 5.0%, preferably 0.1% to 5.0% and more preferably 0.5% to 1.5%, by weight of the diluted lubricant composition. The other components are in proportion to the concentration of the triaryl phosphate ester. For example, when a combination of a non-ionic surfactant and a non-ionic alcohol is used, the surfactant and the non-ionic alcohol together comprise 0.02% to 20% by weight, preferably 1% to 18% by weight, more preferably 2% to 9% by weight, of the diluted lubricant composition. When a high HLB surfactant is used without a non-ionic alcohol, the HLB surfactant comprises 0.05 to 10% by weight, preferably 0.4% to 2.0% by weight, of the diluted lubricant composition.

INDUSTRIAL APPLICABILITY

The compositions are particularly useful as lubricants in metal working processes. These lubricants are generally applicable to the working of ferrous and non-ferrous metals and alloys, especially carbon steel and aluminum.

The lubricant is used in a metal working process by contacting the metal to be worked and/or the metal working machinery with an effective lubricating amount of the diluted lubricant composition by any conventional method, such as spraying, coating, flooding, dipping, etc. As will be apparent to those skilled in the art, an effective lubricating amount is the amount of lubricant composition required to achieve effective lubrication during the metal working process. Effective lubrication is that amount of lubrication that prevents seizure of the tool and prevents excessive tool wear. Seizure of the tool during metal working is an especially serious problem because seizure generally causes the tool to break. Continuous circulation and purification of the lubricant composition is advisable and preferred; removal of accumulated heat by heat exchange is sometimes necessary. At the end of the metal working process, the lubricant composition is removed from the metal by chemical or mechanical cleaning.

The advantageous properties of this invention can be observed by reference to the following examples which illustrate, but do not limit, the invention.

EXAMPLES

| Glossary | |
|---|---|
| Basestick 810 | Pentaerythritol fatty ester, viscosity at 210° F. of about 3 cSt (Sauffer) |
| BPP | Mixture of about 29.5% tri(t-butylphenyl)phosphate, about 49% di(t-butylphenyl)monophenyl phosphate, about 20% mono (t-butylphenyl) diphenyl phosphate, and less than about 5% triphenyl phosphate) |
| Mobil Met S 122 | Commercially available oil-based metal working lubricant (Mobil) |
| Pemulin TR2 | High molecular weigh polyacrylic acid, crosslinked with polyalkenyl polyether (B. F. Goodrich) |
| Pluronic ® 31R1 | Polyoxyethylene/polyoxypropylene block copolymer (HLB = 1.7) (BASF) |
| Triton ® X-100 | Octoynol-9 (PEG-9 octyl phenyl ether, HLB = 13.5) (Union Carbide) |
| Tween ® 80 | Polyoxyethylene sorbitan monooleate (HLB = 15) (ICI) |
| Witconol 14 | Polyglyceryl-4-oleate (HLB = 9.4) (Witco) |

All parts and percentages are by weight and all temperatures are centigrade unless otherwise indicated.

Examples 1–8

A series of concentrated lubricant compositions was prepared and evaluated. Where necessary the ingredients were combined with gentle heating and agitation until a stable solution or emulsion was formed.

Example 1 is a comparative example using a commercially available oil based lubricant.

Example 2 is a comparative example based on Example 1 of Berens, U.S. Pat. No. 4,362,634, incorporated herein by reference. To form the concentrated lubricant composition, 80 parts by weight of a mixture of 95 parts by weight Basestick 810 and 5 parts by weight of BPP was mixed in a blender with 20 parts by weight of Witconol 14 to form the concentrated lubricant composition, which contained 4 part by weight phosphate ester, 76 parts by weight pentaerythritol fatty ester, and 20 parts by weight surfactant. The concentrated lubricant composition (15 parts by weight) and water (85 parts by weight) were mixed in blender at high speed for one minute to form a diluted lubricant composition containing 0.6 part by weight phosphate ester, 11.4 parts by weight pentaerythritol fatty ester, and 3 parts by weight surfactant, and 85 parts by weight water. The diluted lubricant composition was a milky white-brown emulsion that quickly separated.

Examples 3 and 4 are comparative examples of lubricant emulsions that do not contain a phosphate ester.

Examples 5, 6, 7 and 8 are examples of the invention. In Examples 5 and 6, the lubricant compositions comprise a high HLB surfactant (Tween® 80) and an amine neutralized anionic surfactant. In Examples 7 and 8, the lubricant compositions contain a low HLB surfactant (Pluronic® 31R1) and a non-ionic alcohol (Triton® X-100).

The stability of each diluted lubricant composition was measured at room temperature (25° C.), at high temperature (75° C.), and at low temperature (−15° C.). Each diluted lubricant composition was stored at the indicated temperature until signs of separation were observed. The composition was stable if no deemulisification, i.e., phase separation, was observed. A "+" indicates that a composition was stable up to and beyond the number of days quoted.

The performance of the diluted concentrated lubricant compositions was measured using the Pin and Vee Block Test carried out according to ASTM D2670, incorporated herein by reference, with the following variations: the lubricant was first heated to about 120° F. (about 49° C.), the load was raised to about 300 lb (about 136 kg) and held for 2 min, the load was then increased to about 1000 lb (about 454 kg) and held for 2 min, and the load was increased by increments of about 250 lb (113 kg) holding at each stage for 2 min until failure occurred. A Pin and Vee Block Test Unit most closely resembles a drilling operation. The test determines whether the lubricant composition can withstand a high amount of load or contact stress without seizure (failure).

Unlike most metal working operations in which the tool is made of a harder metal than the workpiece, in the test method the tool and the workpiece have equal hardness. Total wear is a mass-balance measurement of the amount of metal worn off the tool during the test. The results are presented in Table 1. "DI Water" is deionized water.

TABLE 1

| Component | 1 | 2 | 3 | 4 | 5 | 6 |
|---|---|---|---|---|---|---|
| Mobil Met S 122 | 100 | | | | | |
| Example of USP 4362434 | | 100 | | | | |
| Inactive Sulfur (Lubrizol 5346) | | | 10 | | | |
| Chlorinated paraffin (Paroil 140) | | | | 10 | | |
| BPP | | | | | 20 | 20 |
| Triphenyl phosphorothionate | | | | | | 10 |
| Non-ionic surfactants and non-ionic alcohols | | | | | | |
| Tween ® 80 | | | | | 10 | 10 |
| Polyethylene glycol 1000 MW | | | 40 | 40 | | |
| Anionic (amine neutralized) surfactants | | | | | | |
| Pemulin TR-2 | | | | | 1 | 1 |
| Triethanolamine | | | 20 | 20 | 10 | 10 |
| DI Water | | | 30 | 30 | 59 | 49 |
| % Dilution in $H_2O$ (wt %) | 5.0(1) | 15.0 | 10.0 | 10.0 | 5.0 | 5.0 |
| Emulsion type | macro | macro | macro | macro | macro | macro |
| Stability (days) | | | | | | |
| Room Temp (25° C.) | 5+ | <1 | <1 | 4+ | 10+ | 10+ |
| High Temp (75° C.) | 5+ | <1 | <1 | n/a | 5+ | 5+ |
| Low Temp (−15° C.) | 5+ | <1 | <1 | n/a | 5+ | 5+ |
| Metalworking Performance | | | | | | |
| Maximum load before failure (lb) | 1750 | 2000 | 2250 | 2250 | 1750 | 2500 |
| Total Wear (wt %) | 2.68 | 1.11 | 2.19 | 3.30 | 3.01 | 0.50 |
| Corrosion Immediately after test | mild | none | mild | mild | none | none |
| Corrosion after 5 days | mild | none | severe | severe | none | none |

| Component | 7 | 8 |
|---|---|---|
| BPP | 10 | 6.6 |
| Triphenyl phosphorothionate | | 3.4 |
| Non-ionic surfactants and non-ionic alcohol | | |
| Pluronic ® 31R1 | 30 | 30 |
| Triton ® X-100 | 30 | 30 |
| DI Water | 30 | 30 |
| % Dilution in $H_2O$ (wt %) | 10 | 10 |
| Emulsion type | micro | micro |
| Stability (days) | | |
| Room Temp (25° C.) | 10+ | 4 |
| High Temp (75° C.) | <1 | <1 |
| Low Temp (−15° C.) | 5+ | <1 |
| Metalworking Performance | | |
| Maximum load before failure (lb) | 2250 | 2250 |
| Total Wear (wt %) | 2.11 | 0.27 |
| Corrosion Immediately after test | none | none |
| Corrosion after 5 days | none | none |

(1) - volume percent, as recommended by manufacturer for optimum performance

The number of wear teeth required to maintain the load at each stage was recorded (WT), the average torque at each stage T (lbf) was calculated, and the average specimen temperature at each stage was measured. The results are presented in Table 2. "F" (failure) means that seizure of the tool occurred during the test.

TABLE 2

| | Stage-by-Stage data: Torque (T-lbf), Specimen temp (ST-° F.) & Wear Teeth (WT) in the modified ASTM D2670 | | | | | | | | | | | | | | | | | |
|---|---|---|---|---|---|---|---|---|---|---|---|---|---|---|---|---|---|---|
| | 1 | | | 2 | | | 3 | | | 4 | | | 5 | | | 6 | | |
| | T | ST | W | T | ST | WT | T | ST | WT | T | ST | WT | T | ST | WT | T | ST | WT |
| 1 (1000 lb) | 47 | 193 | 12 | 29 | 185 | 0 | 30 | 176 | 2 | 47 | 166 | 40 | 33 | 182 | 3 | 36 | 174 | 3 |
| 2 (1250 lb) | 56 | 201 | 35 | 31 | 197 | 2 | 36 | 191 | 10 | 56 | 189 | 11 | 34 | 194 | 18 | 10 | 193 | 1 |
| 3 (1500 lb) | 58 | 205 | 31 | 36 | 205 | 16 | 41 | 198 | 21 | 55 | 191 | 7 | 41 | 198 | 35 | 44 | 197 | 4 |
| 4 (1750 lb) | 64 | 204 | 39 | 42 | 214 | 51 | 53 | 205 | 30 | 57 | 197 | 13 | 56 | 208 | 50 | 48 | 202 | 9 |
| 5 (2000 lb) | F | F | F | 55 | 227 | 236 | 67 | 206 | 32 | 61 | 200 | 46 | F | F | F | 59 | 203 | 26 |
| 6 (2250 lb) | | | | F | F | F | 71 | 206 | 40 | 59 | 199 | 106 | | | | 62 | 198 | 30 |
| 7 (2500 lb) | | | | | | | F | F | F | F | F | F | | | | 56 | 195 | 35 |
| 8 (2750 lb) | | | | | | | | | | | | | | | | F | F | F |

| | Stage-by-Stage data: Torque (T-lbf), Specimen temp (ST-° F.) & Number of Wear Teeth (WT) at that stage | | | | | |
|---|---|---|---|---|---|---|
| | 7 | | | 8 | | |
| | T | ST | WT | T | ST | WT |
| 1 (1000 lb) | 46 | 195 | 5 | 49 | 200 | 6 |
| 2 (1250 lb) | 53 | 198 | 11 | 45 | 195 | 1 |
| 3 (1500 lb) | 55 | 194 | 15 | 42 | 191 | 3 |
| 4 (1750 lb) | 55 | 191 | 20 | 49 | 199 | 7 |
| 5 (2000 lb) | 73 | 188 | 40 | 53 | 213 | 24 |
| 6 (2250 lb) | 75 | 195 | 45 | 53 | 218 | 33 |
| 7 (2500 lb) | F | F | F | F | F | F |
| 8 (2750 lb) | | | | | | |

Example 9

This example exemplifies formation of concentrated lubricant compositions using (1) a mixture of Tween® 80 (HLB=15), a high HLB non-ionic surfactant, and Triton® X-100, a non-ionic alcohol, and (2) a mixture of Pluronic® 31R1 (HLB=1.7), a low HLB non-ionic surfactant, and Triton® X-100, a non-ionic alcohol. $K_m$ is ratio of surfactant (in weight %) to the non-ionic alcohol (in weight %). Results are shown in Table 3 and summarized in FIG. 1.

TABLE 3

| BPP | $H_2O$ | Tween ® 80 | Pluronic ® 31R1 | Triton ® X-100 | Polyglycol MW = 200 | $K_m$ | Emulsion-type: Tween ® 80 | Emulsion-type: P31R1 |
|---|---|---|---|---|---|---|---|---|
| 3.83 | 49.73 | 1.48 | 0 | 44.96 | 0 | 0.033 | micro | |
| 4.27 | 64.23 | 2.66 | 0 | 23.53 | 5.31 | 0.092 | micro | |
| 9.22 | 39.98 | 4.91 | 0 | 45.89 | 0 | 0.107 | micro | |
| 13.63 | 54.51 | 3.41 | 0 | 28.46 | 0 | 0.119 | micro | |
| 20.84 | 41.68 | 6.91 | 0 | 30.56 | 0 | 0.226 | micro | |
| 22.24 | 33.37 | 6.61 | 0 | 37.78 | 0 | 0.175 | micro | |
| 25.01 | 50.02 | 4.16 | 0 | 20.81 | 0 | 0.199 | micro | |
| 28.16 | 28.16 | 11.3 | 0 | 32.37 | 0 | 0.349 | micro | |
| 30.06 | 30.06 | 5.01 | 0 | 34.87 | 0 | 0.143 | macro | |
| 29.94 | 29.94 | 7.49 | 0 | 32.64 | 0 | 0.229 | macro | |
| 8 | 42.59 | 15.94 | 0 | 33.47 | 0 | 0.476 | macro | |
| 21.8 | 34.7 | 0 | 16.27 | 27.1 | 0 | 0.600 | | micro |
| 17.2 | 25.8 | 0 | 25.8 | 31.2 | 0 | 0.826 | | micro |
| 10 | 30 | 0 | 30 | 30 | 0 | 1.000 | | micro |
| 12.73 | 12.73 | 0 | 38.38 | 36.17 | 0 | 1.061 | | macro |

FIG. 1 shows that microemulsions are formed with specific ratios of phosphate ester, non-ionic surfactant, and non-ionic alcohol. For Tween® 80, the high HLB surfactant, the amount of phosphate ester in the microemulsion increases as $K_m$ increases. For Pluronic® 31R1, the low HLB surfactant, the amount of phosphate ester in the microemulsion decreases as $K_m$ increases.

Each of the concentrated lubricant compositions, both macroemulsions and microemulsions, was stable for at least one month at room temperature. The diluted lubricant compositions prepared by diluting 10 parts of each of the concentrated lubricant compositions to 100 parts with water were also stable for at least one month at room temperature.

Having described the invention, we now claim the following and its equivalents.

What is claimed is:

1. A concentrated lubricant composition for use in metal working operations, the composition comprising:

a substantially neutral phosphate ester, said phosphate ester comprising a mixture of a tri(alkylphenyl)

phosphate, a di(alkylphenyl)monophenyl phosphate, a mono(alkylphenyl)diphenylphosphate, and triphenyl phosphate, in which each alkyl group contains one to six carbon atoms;

a surfactant;

a non-ionic alcohol; and water;

in which:

the phosphate ester comprises 5% to 30% by weight of the composition;

the surfactant and the non-ionic alcohol together comprise 10% to 60% by weight of the composition;

the ratio of the total weight of the surfactant and the non-ionic alcohol to the weight of the phosphate ester is 2:1 to 12:1; and the composition is a microemulsion.

2. The composition of claim 1 in which the surfactant is selected from the group consisting of high HLB surfactants and low HLB surfactants.

3. The composition of claim 2 in which the emulsion is stable for at least one month at room temperature.

4. The composition of claim 1 in which the composition does not comprise an extreme pressure additive.

5. The composition of claim 1 in which:

the composition comprises up to about 10% by weight of an extreme pressure additive;

the phosphate ester and the extreme pressure additive together comprise 5% to 30% by weight of the composition; and the ratio of the total weight of the surfactant and the non-ionic alcohol to the total weight of the phosphate ester and the extreme pressure additive is 2:1 to 12:1.

6. The composition of claim 1 in which the extreme pressure additive is triphenylphosphorothionate.

7. The composition of claim 1 in which the surfactant is a high HLB surfactant.

8. The composition of claim 7 in which the high HLB surfactant is selected from the group consisting of polyoxyethylene glycol esters of long chain carboxylic acids, tall oil ethoxylates, castor oil ethoxylates, ethoxylates of the fatty acids derived from coconut oil, and ethoxylates of sorbitol esters of fatty acids.

9. The composition of claim 7 in which the non-ionic alcohol is selected from the group consisting of low molecular weight polyethylene glycols, ethoxylates of straight or branched chain alcohols that comprise at least eight carbon atoms, and ethoxylates of alkyl phenols that comprise at least seven moles of ethylene oxide.

10. The composition of claim 7 in which the microemulsion is stable for at least one month at room temperature.

11. The composition of claim 1 in which the surfactant is a low HLB surfactant.

12. The composition of claim 11 in which the low HLB surfactant is selected from the group consisting of fatty acid esters of polyols, high molecular weight polyethylene glycols, and polyoxyethylene/polyoxypropylene block copolymers.

13. The composition of claim 11 in which the non-ionic alcohol is selected from the group consisting of low molecular weight polyethylene glycols, ethoxylates of straight or branched chain alcohols that comprise at least eight carbon atoms, and ethoxylates of alkyl phenols that comprise at least seven moles of ethylene oxide.

14. The composition of claim 11 in which the microemulsion is stable for at least one month at room temperature.

15. A method for working metal, the method comprising:

(a) contacting a metal workpiece with an effective lubricating amount of a lubricant composition; and (b) working the metal workpiece;

in which:

the lubricant composition comprises:

a substantially neutral phosphate ester, said phosphate ester comprising a mixture of a tri(alkylphenyl) phosphate, a di(alkylphenyl)monophenyl phosphate, a mono(alkylphenyl)diphenylphosphate, and triphenyl phosphate, in which each alkyl group contains one to six carbon atoms;

a surfactant selected from the group consisting of high HLB surfactants and low HLB surfactants;

a non-ionic alcohol; and water;

the phosphate ester comprises 0.1% to 5% by weight of the composition;

the surfactant and the non-ionic alcohol together comprise 0.2% to 20% by weight of the composition;

the ratio of the total weight of the surfactant and the non-ionic alcohol to the weight of the phosphate ester is 2:1 to 12:1; and the composition is a microemulsion.

16. The method of claim 15 in which the surfactant is a high HLB surfactant selected from the group consisting of polyoxyethylene glycol esters of long chain carboxylic acids, tall oil ethoxylates, castor oil ethoxylates, ethoxylates of the fatty acids derived from coconut oil, and ethoxylates of sorbitol esters of fatty acids and the non-ionic alcohol is selected from the group consisting of low molecular weight polyethylene glycols, ethoxylates of straight or branched chain alcohols that comprise at least eight carbon atoms, and ethoxylates of alkyl phenols that comprise at least seven moles of ethylene oxide.

17. The method of claim 15 in which the surfactant is a low HLB surfactant selected from the group consisting of fatty acid esters of polyols, high molecular weight polyethylene glycols, and polyoxyethylene/polyoxypropylene block copolymers and the non-ionic alcohol is selected from the group consisting of low molecular weight polyethylene glycols, ethoxylates of straight or branched chain alcohols that comprise at least eight carbon atoms, and ethoxylates of alkyl phenols that comprise at least seven moles of ethylene oxide.

18. A concentrated lubricant composition for use in metal working operations, the composition comprising:

a substantially neutral phosphate ester said phosphate ester comprising a mixture of tri(alkylphenyl) phosphate, a di(alkylphenyl)monophenyl phosphate, a mono(alkylphenyl)diphenylphosphate, and triphenylphosphate, in which each alkyl group contains one to six carbon atoms;

up to about 10% by weight of an extreme pressure additive;

a surfactant;

a non-ionic alcohol; and water;

in which:

the phosphate ester and the extreme pressure additive together comprise 5% to 30% by weight of the composition;

the surfactant and the non-ionic alcohol together comprise 10% to 60% by weight of the composition;

the ratio of the total weight of the surfactant and the non-ionic alcohol to the total weight of the phosphate ester and the extreme pressure additive is 2:1 to 12:1; and the composition is a microemulsion.

19. The composition of claim 18 in which the surfactant is selected from the group consisting of high HLB surfactants and low HLB surfactants.

20. The composition of claim 19 in which the surfactant is a high HLB surfactant selected from the group consisting of polyoxyethylene glycol esters of long chain carboxylic acids, tall oil ethoxylates, castor oil ethoxylates, ethoxylates of the fatty acids derived from coconut oil, and ethoxylates of sorbitol esters of fatty acids.

21. The composition of claim 19 in which the surfactant is a low HLB surfactant selected from the group consisting of fatty acid esters of polyols, high molecular weight polyethylene glycols, and polyoxyethylene/polyoxypropylene block copolymers.

22. The composition of claim 18 in which the non-ionic alcohol is selected from the group consisting of low molecular weight polyethylene glycols, ethoxylates of straight or branched chain alcohols that comprise at least eight carbon atoms, and ethoxylates of alkyl phenols that comprise at least seven moles of ethylene oxide.

23. A method for working metal, the method comprising:

(a) contacting a metal workpiece with an effective lubricating amount of a lubricant composition; and (b) working the metal workpiece;

in which:

the lubricant composition comprises:

a substantially neutral phosphate ester said phosphate ester comprising a mixture of tri(alkylphenyl) phosphate, a di(alkylphenyl)monophenyl phosphate, a mono(alkylphenyl)diphenylphosphate, and triphenylphosphate, in which each alkyl group contains one to six carbon atoms;

up to about 10% by weight of an extreme pressure additive;

a surfactant;

a non-ionic alcohol; and water;

the phosphate ester and the extreme pressure additive together comprise 5% to 30% by weight of the composition;

the surfactant and the non-ionic alcohol together comprise 10% to 60% by weight of the composition;

the ratio of the total weight of the surfactant and the non-ionic alcohol to the total weight of the phosphate ester and the extreme pressure additive is 2:1 to 12:1; and the composition is a microemulsion.

24. The method of claim 23 in which the surfactant is selected from the group consisting of high HLB surfactants and low HLB surfactants.

25. The method of claim 24 in which the surfactant is a high HLB surfactant selected from the group consisting of polyoxyethylene glycol esters of long chain carboxylic acids, tall oil ethoxylates, castor oil ethoxylates, ethoxylates of the fatty acids derived from coconut oil, and ethoxylates of sorbitol esters of fatty acids.

26. The method of claim 24 in which the surfactant is a low HLB surfactant selected from the group consisting of fatty acid esters of polyols, high molecular weight polyethylene glycols, and polyoxyethylene/polyoxypropylene block copolymers.

27. The method of claim 23 in which the non-ionic alcohol is selected from the group consisting of low molecular weight polyethylene glycols, ethoxylates of straight or branched chain alcohols that comprise at least eight carbon atoms, and ethoxylates of alkyl phenols that comprise at least seven moles of ethylene oxide.

28. A method for working metal, the method comprising:

(a) contacting a metal workpiece with an effective lubricating amount of a lubricant composition; and (b) working the metal workpiece;

in which:

the lubricant composition comprises:

a substantially neutral phosphate ester, said phosphate ester comprising a mixture of a tri(alkylphenyl) phosphate, a di(alkylphenyl)monophenyl phosphate, a mono(alkylphenyl)diphenylphosphate, and triphenyl phosphate, in which each alkyl group contains one to six carbon atoms;

a surfactant;

a non-ionic alcohol; and water;

the phosphate ester comprises 5% to 30% by weight of the composition;

the surfactant and the non-ionic alcohol together comprise 10% to 60% by weight of the composition;

the ratio of the total weight of the surfactant and the non-ionic alcohol to the weight of the phosphate ester is 2:1 to 12:1; and the composition is a microemulsion.

29. The method of claim 28 in which the surfactant is selected from the group consisting of high HLB surfactants and low HLB surfactants.

30. The method of claim 29 in which the surfactant is a high HLB surfactant selected from the group consisting of polyoxyethylene glycol esters of long chain carboxylic acids, tall oil ethoxylates, castor oil ethoxylates, ethoxylates of the fatty acids derived from coconut oil, and ethoxylates of sorbitol esters of fatty acids.

31. The method of claim 29 in which the surfactant is a low HLB surfactant selected from the group consisting of fatty acid esters of polyols, high molecular weight polyethylene glycols, and polyoxyethylene/polyoxypropylene block copolymers.

32. The method of claim 28 in which the non-ionic alcohol is selected from the group consisting of low molecular weight polyethylene glycols, ethoxylates of straight or branched chain alcohols that comprise at least eight carbon atoms, and ethoxylates of alkyl phenols that comprise at least seven moles of ethylene oxide.

33. A concentrated lubricant composition for use in metal working operations, the composition comprising:

a substantially neutral phosphate ester, said phosphate ester comprising a mixture of a tri(alkylphenyl) phosphate, a di(alkylphenyl)monophenyl phosphate, a mono(alkylphenyl)diphenylphosphate, and triphenyl phosphate, in which each alkyl group contains one to six carbon atoms;

a surfactant selected from the group consisting of high HLB surfactants and low HLB surfactants;

a non-ionic alcohol; and water;

in which:

the phosphate ester comprises 0.1% to 5% by weight of the composition;

the surfactant and the non-ionic alcohol together comprise 0.2% to 20% by weight of the composition;

the ratio of the total weight of the surfactant and the non-ionic alcohol to the weight of the phosphate ester is 2:1 to 12:1; and the composition is a microemulsion.

* * * * *